US006167815B1

(12) United States Patent
Werner et al.

(10) Patent No.: US 6,167,815 B1
(45) Date of Patent: Jan. 2, 2001

(54) RAIL VEHICLE WITH AN IMPACT ABSORBING DEVICE

(75) Inventors: Friedrich Werner, Wangen; Max Huber, Bäumenheim, both of (DE)

(73) Assignee: ABB Daimler-Benz Transportation (Technology) GmbH (DE)

( * ) Notice: Under 35 U.S.C. 154(b), the term of this patent shall be extended for 0 days.

(21) Appl. No.: 09/214,857

(22) PCT Filed: Apr. 29, 1998

(86) PCT No.: PCT/EP98/02523

§ 371 Date: Jan. 13, 1999

§ 102(e) Date: Jan. 13, 1999

(87) PCT Pub. No.: WO98/51555

PCT Pub. Date: Nov. 19, 1998

(30) Foreign Application Priority Data

May 15, 1997 (DE) ..... 197 20 329

(51) Int. Cl.[7] ..... B61D 17/00

(52) U.S. Cl. ..... 105/392.5; 2/220

(58) Field of Search ..... 105/26.05, 392.5, 105/394, 420, 421, 72.2; 213/220, 221, 222, 223; 296/189; 293/24, 25, 26, 38, 39, 102

(56) References Cited

U.S. PATENT DOCUMENTS

| | | | | |
|---|---|---|---|---|
| 596,227 | * | 12/1897 | Andrews | 213/220 |
| 4,576,294 | * | 3/1986 | Forster | 213/220 |
| 4,715,292 | * | 12/1987 | Pavlick et al. | 105/392.5 |
| 5,579,699 | * | 12/1996 | Dannawi et al. | 296/189 |

FOREIGN PATENT DOCUMENTS

| | | |
|---|---|---|
| 635018 | 9/1936 | (DE) . |
| 2910481 | 9/1979 | (DE) . |
| 3228942 | 9/1984 | (DE) . |
| 0655565 | 5/1995 | (EP) . |

* cited by examiner

*Primary Examiner*—Mark T. Le
(74) *Attorney, Agent, or Firm*—Webb, Ziesenheim, Logsdon, Orkin & Hanson, P.C.

(57) ABSTRACT

A railway vehicle has, located centrally on the end of a car body 1, a coupling device and at least one shock absorbing device 9, 10, which has a permanently deformable support element. To achieve an effective protection against underrunning in an impact the, individual shock absorbing elements 9, 10 are parallel to one another underneath a horizontal plane that contains a coupling device 4.

15 Claims, 2 Drawing Sheets

RAIL VEHICLE WITH AN IMPACT ABSORBING DEVICE

BACKGROUND OF THE INVENTION

1. Field of the Invention

This invention relates to a railway vehicle.

2. Description of the Prior Art

On a railway vehicle of the prior art disclosed in DE 3228942 C2, fastened to the undercarriage of a car body is a mounting which supports the coupling device that runs centrally in the longitudinal center axis of the car body and points toward the end of the car body. The mounting also supports a shock absorbing element device that is located above the coupling device and below the undercarriage. This shock absorbing element device also runs in the longitudinal direction of the car body and, like the coupling device, projects beyond the end of the car body in the longitudinal direction of the car body. The shock absorbing element device has an impact plate on its exposed end, while on the opposite end it is rigidly supported on the undercarriage. Between the support and the impact plate, the compression rod construction includes at least one support element which, when a specified mechanical load is exceeded, undergoes a permanent change in shape and thereby absorbs the force of the impact at least largely inelastically. The impact plate thereby has a plurality of pyramid-shaped elevations that are located next to and above one another, and provides protection against a tilting of the car, which prevents the railway vehicles in question from climbing on top of one another and from moving laterally in relation to one another in the event of an impact.

The object of the invention is to provide measures on a railway vehicle by which under-running can be prevented.

SUMMARY OF THE INVENTION

The invention teaches that this object can be accomplished by a railway vehicle made in accordance with the present invention.

On a railway vehicle in accordance with the present invention, the damage that can occur on the end portion when the railway vehicle rams into trees that have fallen onto the tracks, or trucks, automobiles, large animals etc., can be prevented because the structure of the car body that lies behind the front part in the direction of travel remains largely undamaged. Such impacts generally occur below the plane in which the coupling device is located.

Preferably, there are a plurality of, and in particular four, individual shock absorbing elements that are arranged symmetrically with respect to the vertical center plane of the car body, and are fastened individually, in pairs or jointly in groups on a beam on the car body. In particular, the arrangement of the shock absorbing elements is such that they are located in pairs in the longitudinal direction of the vehicle so that the distances between the contact surfaces of the shock absorbing elements can absorb a moment of force introduced in a manner that could push the shock absorbing elements of the under-running guard downward. For this purpose, the individual shock absorbing elements are located next to one another in a horizontal plane. So that it is also possible to absorb in a graduated manner any impact moment that occurs, the middle shock absorbing element or elements are displaced forward toward the front end of the car body with respect to the laterally neighboring shock absorbing elements. As a result, the middle portion of the shock absorbing element device is generally the first to come in contact with the obstacle, thereby initiating a disintegration of the obstacle. The pieces of the obstacle that are moved sideways are then impacted by the recessed shock absorbing elements. A load that exceeds the specified load thereby results in a permanent deformation of the support element on the respective shock absorbing element in question, so that a significant portion of the impact energy is already absorbed and is not transmitted to the car body.

To prevent any interference with easy access to the coupling device, the exposed ends of the shock absorbing elements can be recessed in the longitudinal direction of the car axially towards the middle part of the car body with respect to the exposed end of the coupling device. The center shock absorbing elements in particular are thereby fastened jointly to the connection-side end of the leg of a rigid U-shaped or V-shaped beam, the exposed ends of which, as well as the outer shock absorbing elements are fastened jointly to the undercarriage. The ends of this beam, however, can for their part also be fastened to a point on the car body that is offset from the fastening points of the outer shock absorbing elements, in particular in the longitudinal direction of the car, to achieve a distribution of any impact force that occurs to the undercarriage of the car body. At the same time, when impact forces occur that have a force component that deviates from the longitudinal axis, a buckling of the system, in particular a downward buckling, is prevented.

To promote the disintegration of the obstacle, the center shock absorbing elements can be located next to one another with only a small space in between, so that the point of the initial introduction of force is directed toward the central portion of the obstacle. The distance to the shock absorbing elements located to the sides can thereby be greater and can be designed so that there is sufficient protection and a clearing action for the trailing truck. A shock absorbing element device of this type is accordingly highly suitable for installation in the nose area of a high-speed railway vehicle. In that case, it is also appropriate, in the area that contains the shock absorbing elements, to continue the front wall of the car body beyond the shock absorbing elements, and to thereby realize the front wall of the car body in a V-shape similar to the generating curve of an envelope. The shock absorbing elements are thereby concealed behind a streamlined skin for normal operation and do not generate any noise. The permanently deformable support elements thereby consist in particular of tubular sleeves that are manufactured from fiberglass-reinforced plastic or metal, or a combination of the two, and extend approximately over the entire length of the respective shock absorber element.

The invention is explained in greater detail below with reference to the exemplary embodiments illustrated in the accompanying figures.

DETAILED DESCRIPTION OF THE PREFERRED EMBODIMENTS

Figure 1:
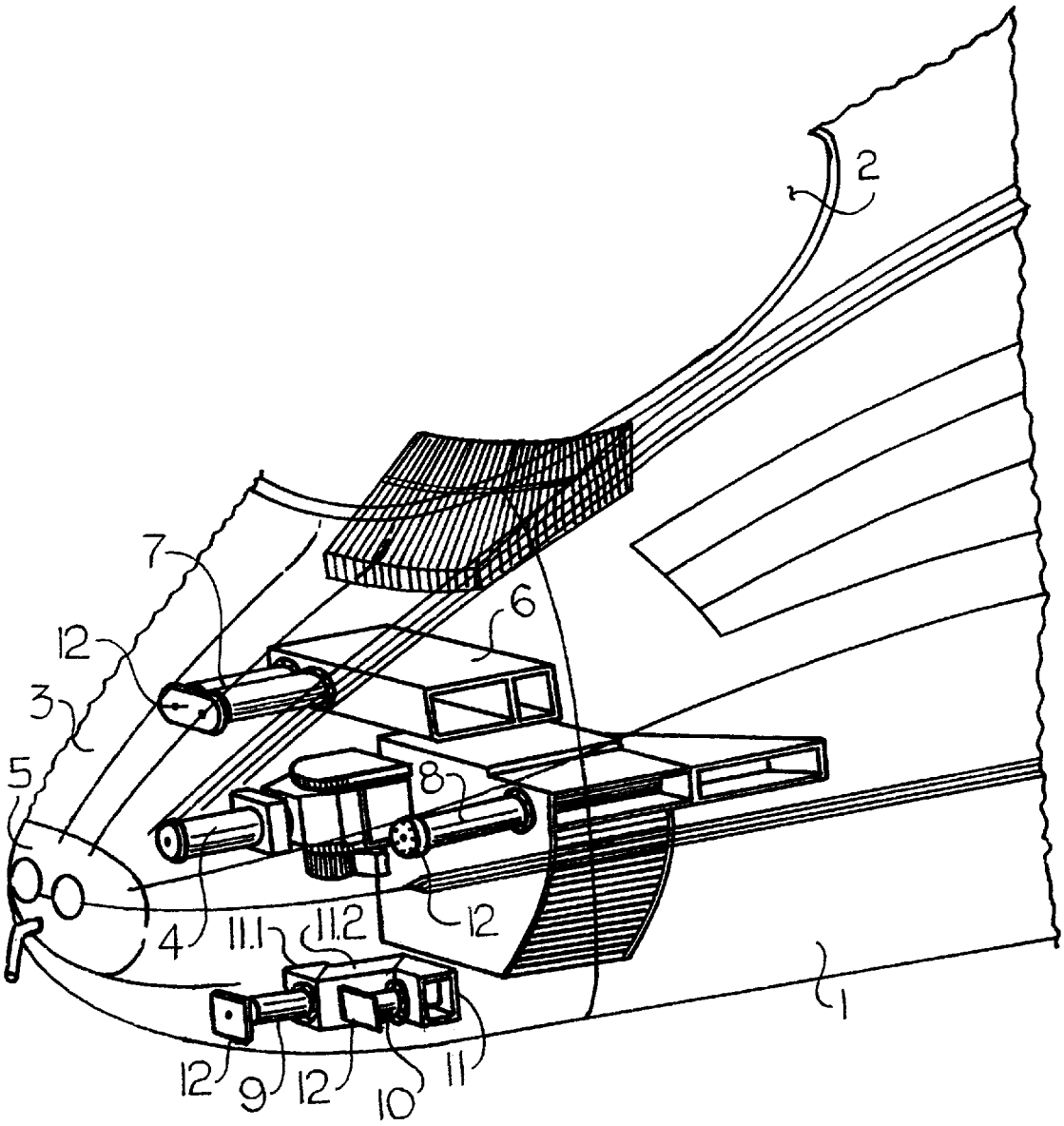
FIG. 1 shows the nose portion of a high-speed railway velicle with a shock absorbing element device, in longitudinal section and in a perspective view.

Referring to FIG. 1, the nose of a car body 1 of a high-speed railway vehicle has a window cutout 2 in the vicinity of the driver's cab, and in the front end, in front of the window 2 of the driver's cab, the car body makes a transition into an aerodynamically designed end wall 3 molded in a V-shape or a U-shape in the manner of the nose of an aircraft. Located centrally in the longitudinal center of the car body 1, in the vicinity of the end wall 3, there is a coupling device 4 which makes possible a mechanical coupling with other cars or traction devices and is accessible after the removal or lateral pivoting of a front part 5 of the end wall 3. Above the coupling device 4, on a crossbar 6 in front of the driver's console, there is an impact absorbing element device 7 which, in the event of an accident, protects the driver's console against the force of the impact. In a plane that also contains the coupling device 4, on both sides of the coupling device 4 in the vicinity of the buffer system that is conventional on railway vehicles, there are additional shock absorbing element devices that absorb impact forces that occur at the level of the coupling device 4.

Thus, obstacles lying on the rails or between the rails do not result in any damage to important operating parts of the car body or to the truck supporting the car body, if a plurality of individual shock absorbing elements 9 and 10 are located parallel to one another in a plane underneath the coupling device 4, which shock absorbing elements are arranged symmetrically with respect to the vertical center plane of the car body 1. The shock absorbing element devices 7, 8, 9, 10 are thereby also provided in a symmetrical arrangement in the second half of the car body not shown in FIG. 1. The shock absorbing element devices 7, 8, 9, 10 thereby preferably consist of tubular plastic sleeves reinforced with glass, carbon or similar fibers, and extend essentially over the entire axial length of the shock absorbing element devices.

The four individual shock absorbing elements 9, 10 provided as protection against under-running are located next to one another in a horizontal plane. The two shock absorbing elements 9 next to the longitudinal center line, or middle part, of the car body are at a smaller axial distance from one another than the distance between one of these center shock absorbing elements 9 and the neighboring outer shock absorbing element 10. The exposed ends of the center shock absorbing elements 9 are thereby axially in front of the exposed ends of the outer shock absorbing elements 10. When trees and similar obstacles that may be lying across the rails come into contact with the center shock absorbing elements 9 that project forward in the direction of travel, they are first broken and then, after they have been impacted by the axially recessed outer shock absorbing elements, they are flung outward and away from the tracks and out of the area of movement of the car body 1 or the truck. If forces occur during this process that exceed a defined magnitude, the shock absorbing elements are permanently deformed by absorbing the mechanical energy, so that the impact forces that are transmitted to the car body are reduced accordingly.

As illustrated in FIG. 1, the individual, essentially cylindrical shock absorbing elements 9, 10 sit on a common beam 11 which is realized in the form of a horizontal U or V, whereby the two neighboring shock absorbing elements 9 located next to the longitudinal center line of the car body 1 are fastened on the connection-side end 11.1 that points forward in the direction of travel of the legs 11.2 of the beam that are inclined toward one another. The outer shock absorbing elements 10, on the other hand, sit on the terminal segments of the beam 11 that are bent at a right angle to the longitudinal axis of the car body with respect to the legs 11.2. The shock absorbing element device thereby forms an assembly that for its part can be fastened to the car body or its undercarriage.

Figure 2:
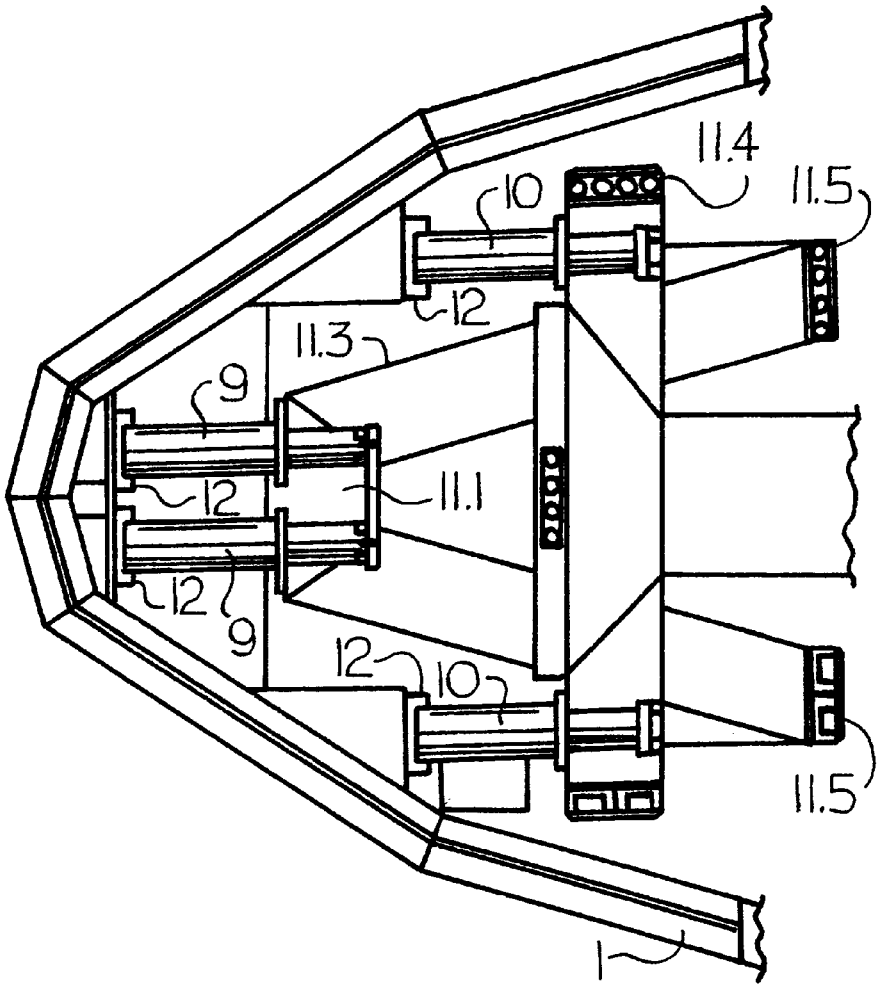
FIG. 2 is a plan view of a railway vehicle with a modified shock absorbing element device.

In the embodiment illustrated in FIG. 2, with an otherwise identical configuration, the center shock absorbing elements 9 sit on their own V-shaped or U-shaped partial beam 11.3, while the outer shock absorbing elements 10 are fastened to an independent partial beam 11.4. The free ends 11.5 of the partial beam 11.3 facing away from the shock absorbing elements 9 are thereby fastened in a transverse plane of the car body 1 that is offset more toward the center of the car body than the transverse plane in which the partial beam 11.4 for the outer shock absorbing elements 10 is fastened to the car body 1 or to its undercarriage or to a suitable mounting on the undercarriage.

Figure 3:
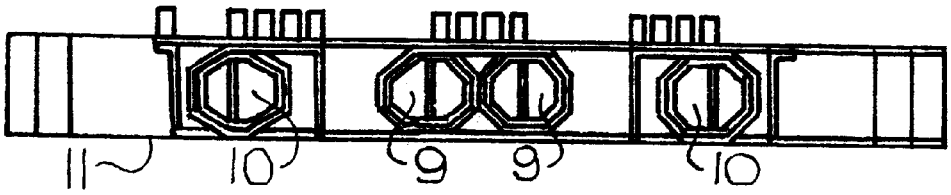
FIG. 3 is a front view of a shock absorbing element device as illustrated in FIG. 1 or FIG. 2.

As a result of the configuration of the beam 11 with the shock absorbing elements 9, 10 as illustrated in FIGS. 2 or 3, any moment that may be introduced that might push this under-running guard downward can be safely absorbed.

FIG. 3 shows a front view of the system of the individual shock absorbing elements 9 and 10 in a horizontal plane next to one another on the beam 11. To improve the introduction of force in the event of a collision, flat impact plates 12 are thereby placed on the free ends of each of the shock absorbing elements 7, 8, 9, 10.

FIG. 1 also shows that the shock absorbing elements 9, 10 that provide protection against under-running sit below the end wall 3 of the car body that is curved to form a sort of nose, and are thereby covered by a streamlined V-shaped skirt that is molded in a V-shape in the manner of a generating curve of an envelope to correspond to the wedge-shaped arrangement of the shock absorbing elements 9, 10. The peak of the generating curve of the envelope that points forward in the direction of travel can thereby be realized in the form of a bezel or cutting edge that separates the weaker portions of the obstacle without applying any load to the shock absorbing elements, and transmits the impact forces away from the driver's cab of the railway vehicle.

What is claimed is:

1. A railway vehicle with a car body having centrally located on a front end a coupling device and at least one shock absorbing device that points toward said front end of the car body, with the shock absorbing device having a plurality of individual shock absorbing elements (9, 10) that comprise at least one permanently deformable support element and are located parallel to one another and arranged symmetrically with respect to a vertical center plane of the car body (1), the shock absorbing elements located at least below a horizontal plane that contains the coupling device (4).

2. The railway vehicle as claimed in claim 1, wherein four of the individual shock absorbing elements (9, 10) are located next to one another in a horizontal plane.

3. The railway vehicle as claimed in claim 1 wherein two of the shock absorbing elements (9, 10) next to a middle part of the car body (1) project axially toward the front end of the car body (1) beyond others of the shock absorbing elements (9, 10) that are recessed toward a side wall of the car body (1).

4. The railway vehicle as claimed in claim 1, wherein free ends of the shock absorbing elements (9, 10) are axially recessed with respect to an exposed end of the coupling device (4) toward a middle part of the car body (1).

5. The railway vehicle as claimed in claim 1, wherein the shock absorbing elements (9, 10) have rigid impact plates (12) on their exposed end surfaces.

6. The railway vehicle as claimed in claim 5, wherein the impact plates (12) project radially beyond a surface of the shock absorbing elements (9, 10).

7. The railway vehicle as claimed in claim 1, wherein two of the shock absorbing elements (9) located next to a middle part of the car body (1) are fastened jointly to a connection-side end (11.1) of legs (11.2) of a rigid U-shaped or V-shaped beam (11), and wherein free ends of the legs (11.2) are fastened to the car body (1).

8. The railway vehicle as claimed in claim 1 wherein the shock absorbing elements (9) located next to a middle part of the car body (1) are supported on a plane which is lower than the middle part of the car body (1).

9. The railway vehicle as claimed in claim 1, wherein the individual shock absorbing elements (9, 10) are supported on a common beam (11) on an undercarriage of the car body.

10. The railway vehicle as claimed in claim 1, wherein a horizontal center-to-center distance between the shock absorbing elements (9) located next to a middle part of the car body (1) is less than a distance between one of the shock absorbing elements (9) located next to the middle part of the carbody and an outer most one of the shock absorbing elements (9, 10).

11. The railway vehicle as claimed in claim 1, wherein a front wall (3) of the car body (1) is molded in an area that contains the shock absorbing elements (9, 10) in a manner of a V-shaped curve corresponding to exposed end-points of the shock absorbing elements (9, 10).

12. The railway vehicle as claimed in claim 1, wherein the at least one support element of the shock absorbing elements (9, 10) comprises tubular sleeves made of glass-fiber reinforced plastic.

13. The railway vehicle as claimed in claim 1, wherein a plurality of additional shock absorbing elements (7) are positioned parallel to one another in the longitudinal direction of the car body (1) in a horizontal plane above the coupling device (4).

14. The railway vehicle as claimed in claim 13, wherein each two adjacent ones of said additional shock absorbing elements (7) have a common impact plate (12) on their ends.

15. The railway vehicle as claimed in claim 1, wherein at least one further shock absorbing element (8) is located in a horizontal plane laterally next to the coupling device (4).

* * * * *